US012543809B2

(12) United States Patent
Watts

(10) Patent No.: US 12,543,809 B2
(45) Date of Patent: Feb. 10, 2026

(54) ERGONOMIC DUTY BELT

(71) Applicant: Tedder Industries, LLC, Post Falls, ID (US)

(72) Inventor: Randy Watts, Spokane, WA (US)

(73) Assignee: Tedder Industries, LLC, Post Falls, ID (US)

( * ) Notice: Subject to any disclaimer, the term of this patent is extended or adjusted under 35 U.S.C. 154(b) by 0 days.

(21) Appl. No.: 18/584,552

(22) Filed: Feb. 22, 2024

(65) Prior Publication Data

US 2025/0268323 A1 Aug. 28, 2025

(51) Int. Cl.
*A41F 9/02* (2006.01)

(52) U.S. Cl.
CPC ..... *A41F 9/025* (2013.01)

(58) Field of Classification Search
CPC ..... A41F 9/002; A41F 9/007; A41F 9/025; A41D 2200/10
USPC ..... 2/309, 338, 322, 311, 312, 321
See application file for complete search history.

(56) References Cited

U.S. PATENT DOCUMENTS 1,607,921 A * 11/1926 Schleimer ..... A41F 9/007 24/318
2,586,457 A * 2/1952 Epstein ..... A41F 9/002 2/322
2,923,010 A * 2/1960 Borzone ..... A41F 9/002 2/322
3,271,783 A * 9/1966 Mallett ..... A41F 9/007 2/236
4,627,132 A * 12/1986 Markham ..... A41F 9/007 24/546
5,106,004 A * 4/1992 Nguyen ..... A41F 9/002 224/163
8,015,623 B2 * 9/2011 Lee ..... A41F 9/002 2/311
8,060,995 B2 * 11/2011 Issler ..... A43C 3/00 24/714.6
10,542,784 B2 * 1/2020 Groff ..... A41F 9/025
(Continued)

FOREIGN PATENT DOCUMENTS

CH 567380 A5 * 10/1975 ..... A41F 9/002
DE 2707896 A1 * 8/1978 ..... A41F 9/007
(Continued)

OTHER PUBLICATIONS

"Buckle." Merriam Webster Dictionary. Mar. 6, 2025. (Year: 2025).*

*Primary Examiner* — Grace Huang
(74) *Attorney, Agent, or Firm* — Iron Summit IP LLP

(57) ABSTRACT

In various examples, a belt (e.g., duty belt, service belt, etc.) may include a strap and a first member for detachably coupling a first buckle component to the strap proximate a first end of the strap. The belt may also include a second member for detachably coupling a second buckle component to the strap proximate a second end of the strap. In some instances, one or more connection points may be disposed in the strap proximate the second end, and the connection point(s) may be for adjusting a position of the second member to adjust a size of the belt. In some examples, the first member and the second member may be disposed on a same side of the duty belt and the first end of the strap may at least partially overlap the second end of the strap when worn by a user.

17 Claims, 8 Drawing Sheets

(56) References Cited

U.S. PATENT DOCUMENTS

| | | | | |
|---|---|---|---|---|
| 11,193,731 | B2 * | 12/2021 | Shearer | F41C 33/046 |
| 11,224,531 | B2 * | 1/2022 | Strohm | A41F 9/025 |
| 11,291,460 | B2 * | 4/2022 | Watts | A61B 17/1322 |
| 11,723,439 | B2 * | 8/2023 | Banks | A44B 11/223 2/322 |
| 2003/0233700 | A1 * | 12/2003 | Cress | A44B 11/24 2/338 |
| 2004/0083525 | A1 * | 5/2004 | Wells, Jr. | F41H 1/02 2/2.5 |
| 2009/0126083 | A1 * | 5/2009 | Holtzclaw, Jr. | A41F 9/002 2/300 |
| 2012/0185996 | A1 * | 7/2012 | Goldberg | A43B 23/24 2/244 |
| 2012/0317703 | A1 * | 12/2012 | Mongan | A44B 11/12 2/338 |
| 2015/0013048 | A1 * | 1/2015 | Kim | A44B 11/24 2/321 |
| 2015/0135409 | A1 * | 5/2015 | Mongan | A41F 9/00 2/312 |
| 2017/0000249 | A1 * | 1/2017 | Beck | A41F 9/002 |
| 2017/0051999 | A1 * | 2/2017 | Tedder | F41C 33/046 |
| 2024/0389694 | A1 * | 11/2024 | Chen | A41F 9/025 |

FOREIGN PATENT DOCUMENTS

| | | | | |
|---|---|---|---|---|
| WO | WO-2005023035 | A1 * | 3/2005 | A41F 9/007 |
| WO | WO-2022053340 | A1 * | 3/2022 | A41F 9/002 |

* cited by examiner

ERGONOMIC DUTY BELT

BACKGROUND

Military, law enforcement, security, and/or other protective personnel may utilize one or more accessories during the performance of their assigned duties. For instance, such accessories may include, but are not limited to, flashlights, chemical agent dispensers, restraint devices, communication equipment, firearms, one or more magazines or clips for the firearms, and/or medical equipment. Typically, the accessories may be attached to a belt (e.g., a "duty belt") worn upon the waist of a user, allowing quick access to the accessories and keeping the user's hands free for other tasks.

However, current belts used by protective personnel for such purposes are generally uncomfortable as they do not provide for the ergonomic comfort of the user. For instance, current belts may be difficult to adjust size to fit different users and/or to accommodate changes in a user's waist size. Additionally, current belts may include multiple layers of material and/or fold-overs, making it difficult for current belts to form to a user's unique waist and/or body shape. Because of these shortcomings, current belts may cause protective personnel to suffer discomfort during use, such as experiencing numbness and/or tingling from pinched nerves. In some cases, such discomfort may lead to permanent nerve damage and/or other injuries.

SUMMARY

Embodiments of the present disclosure relate to an ergonomic duty belt. In accordance with some embodiments of the present disclosure, a belt (e.g., duty belt, service belt, etc.) may include a strap and a first member for detachably coupling a first buckle component to the strap proximate a first end of the strap. In some examples, the belt may also include a second member for detachably coupling a second buckle component to the strap proximate a second end of the strap. In some instances, one or more connection points may be disposed in the strap proximate the second end. As described herein, the connection point(s) may be for adjusting a position of the second member to adjust a size of the belt. In some examples, the first member and the second member may be disposed on a same side of the duty belt. As such, and as described herein, the first end of the strap may at least partially overlap the second end of the strap based at least on a connection being made between the first buckle component and the second buckle component.

In contrast to conventional belt systems, such as those described above, the current systems, in some embodiments, are able to easily adjust size to perfectly fit a user and/or to accommodate changes in the user's waist size over time. As described in more detail herein, by including the connection point(s) for adjusting a size of the belt, the current belt systems may be easily re-sized over time as the user's waist size changes, allowing the user to keep wearing the same belt without having to purchase a different size belt. Additionally, in contrast to the conventional belt systems, the current systems, in some embodiments, are able to precisely fit a user by eliminating fold-overs in the belt that make it difficult for conventional duty belts to form to a user's unique waist and/or body shape. As described in more detail herein, by eliminating the shortcomings of conventional duty belt systems, the current systems are able to eliminate user discomfort that could potentially lead to permanent nerve damage and/or other injuries.

BRIEF DESCRIPTION OF THE DRAWINGS

The embodiments of the present disclosure relating to an ergonomic duty belt are described in detail below with reference to the attached drawing figures, wherein.

DETAILED DESCRIPTION

Figure 1:
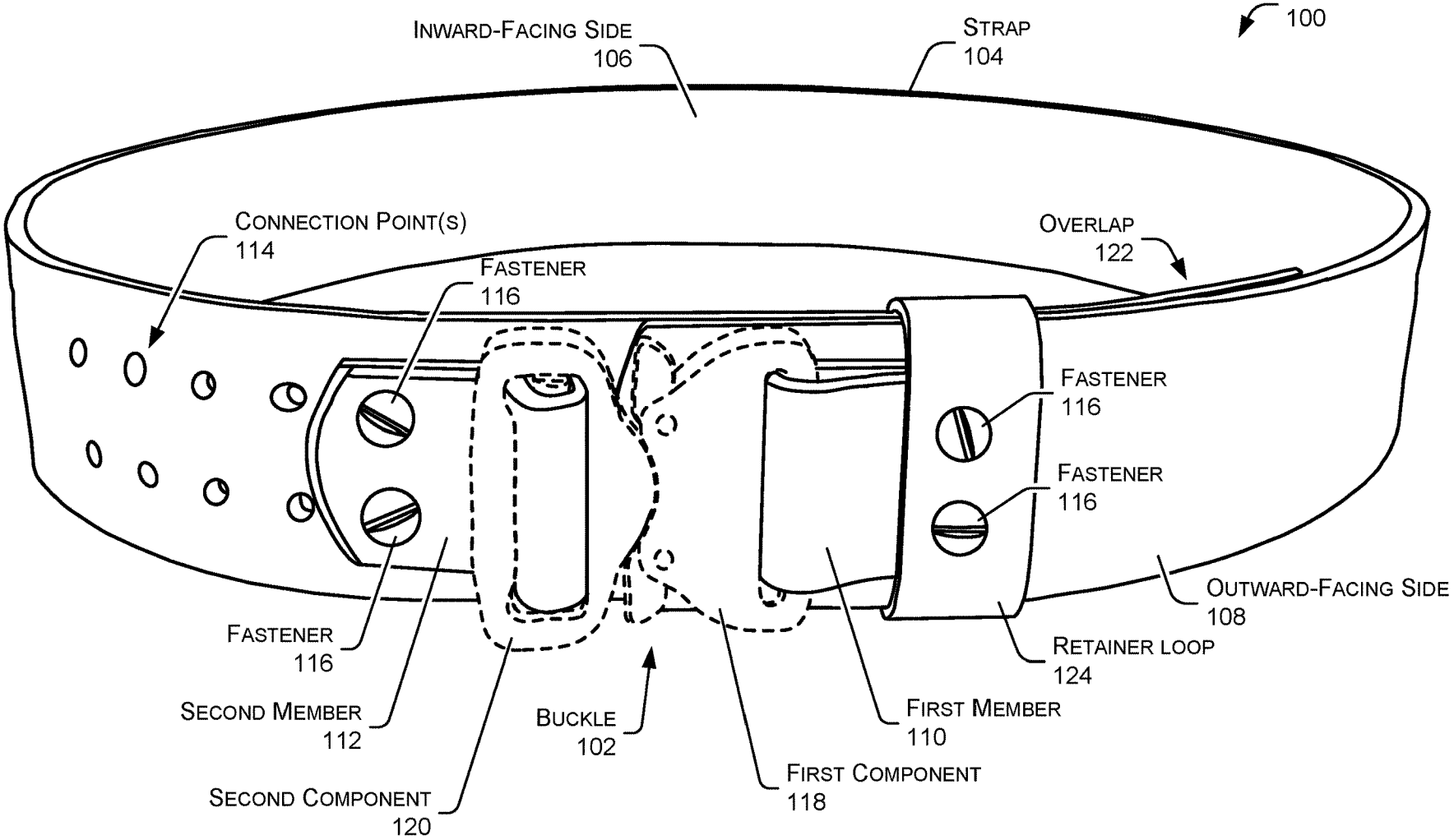
FIG. 1 is a perspective view of an exemplary belt including a multi-component buckle, in accordance with some embodiments of the present disclosure.

This application relates to an ergonomic duty belt. For instance, in accordance with some embodiments of the present disclosure, a belt (e.g., duty belt, service belt, etc.) may include a strap. In some examples, the strap may comprise one or more pieces and/or layers of material (e.g., leather, plastic, etc.) that forms a main body of the belt. For instance, the strap may comprise an outer layer and an inner, structural core. In some examples, the outer layer may be leather, vinyl, or another soft, pliable material, and the inner core may be plastic (e.g., polyethylene, polypropylene, PVC, Polycarbonate, etc.), metal (e.g., aluminum, or another type of ductile metal) or another type of rigid material. The strap may be configured to wrap around the waist or hips of a user. In some instances, the strap may be associated with various dimensions in length, width, thickness, etc. For example, a length of the strap may be in a range between 24 inches to 52 inches, a width of the strap may be in a range of 1 inch to 3 inches, and a thickness of the strap may be a range between ⅛ inch to ½ inch. However, these are merely exemplary dimensions, and other dimensions may be used. In examples, the strap may include a first end and a second end. Additionally, the strap may include a first side (e.g., an inward or user-facing side) and a second side (e.g., an outward-facing side).

In some examples, the belt may include one or more members for detachably coupling a buckle and/or a buckle component(s). For instance, the member(s) may be configured to detachably couple to the strap of the belt via one or more connection points disposed in the strap. That is, in some examples, to couple the buckle and/or the buckle component(s) to the strap of the belt, the member(s) may be detached from the strap, coupled with the buckle and/or buckle component(s), and then recoupled to the strap along with the buckle and/or the buckle component(s). For instance, the member(s) may include a loop or section of material that is inserted through a female portion of the buckle and/or buckle component(s) to couple with the buckle and/or buckle component(s). In some instances, the member(s) may also be referred to herein as "buckle attachment member(s)" or "buckle attachment component(s)." In examples, the configuration of the member(s) may allow a user to utilize a specific buckle of their choosing, such as a multi-component buckle (e.g., a quick-release buckle) having a male portion and a female portion that couple together for a quick and secure connection.

In some examples, the connection point(s) disposed in the strap may include a set of holes through the strap (e.g., drilled, punched, etc.) from the first side to the second side. In some instances, the connection point(s) may span a full length of the strap (e.g., from one end to another end) or may be located at specific portions of the strap. For example, the connection point(s) may be located proximate the ends of the strap. That is, a first set of connection point(s) may be disposed in the strap proximate a first end of the strap and a second set of connection point(s) may be disposed in the strap proximate a second end of the strap. In some examples, the ends of the strap may include one or more sets of the connection point(s) for adjustability. As described herein, the connection point(s) may, in some examples, be configured or sized in such a way that a fastener(s) (e.g., Chicago screws, binding posts, screw posts, interlocking fasteners, rivets, etc.) may be inserted through the strap via the connection point(s) to detachably couple the member(s), as described herein.

For example, the belt may include a first member that is detachably coupled to the strap via first connection point(s) proximate a first end of the strap. Additionally, the belt may include a second member that is detachably coupled to the strap via second connection point(s) proximate a second end of the strap. In some examples, the first member and the second member may include their own connection point(s) to detachably couple to the strap using the fastener(s). For instance, the first member may include connection point(s) that align with the first connection point(s) proximate the first end of the strap, and the fastener(s) may be inserted through the connection point(s) of both the first member and the strap to couple the first member to the strap. Similarly, the second member may include connection point(s) that align with the second connection point(s) proximate the second end of the strap, and the fastener(s) may be inserted through the connection point(s) of both the second member and the strap to couple the second member to the strap.

In some examples, the strap may include one or more of the connection point(s) for adjusting a position of the member(s) to adjust a size of the belt. For instance, proximate the end(s) of the strap/belt at least a first connection point(s) and a second connection point(s) may be disposed in the strap. The first connection point(s) may be associated with a first size of the belt and the second connection point(s) may be associated with a second size of the belt. That is, when the member is detachably coupled to the strap via the first connection point(s), the belt may correspond with a first size (e.g., 34 inches) and, when the member is detachably coupled to the strap via the second connection point(s), the belt may correspond with a second size (e.g., 36 inches).

In some examples, the belt may be configured such that the first member and the second member are disposed on a same side of the strap. For instance, the first member and the second member may be disposed on the outward facing side of the strap. In this way, and as described herein, when the belt is worn by a user, the end(s) of the strap may at least partially overlap. That is, when the belt is worn upon the user such that a connection is made with the buckle, the ends of the strap may at least partially overlap depending on the current size configuration of the belt. For instance, the outward facing side of one end of the strap may contact the inward facing side of the other end of the strap. As an example, the inward-facing side of the second end of the strap may be proximate the user of the belt, the outward-facing side of the second end of the strap may be at least partially overlapped and/or occluded by the first end of the strap, and the inward-facing side of the first end of the strap may be proximate the outward-facing side of the second end of the strap.

In some examples, the belt may further include a retainer loop detachably coupled to the strap of the belt. In some examples, the retainer loop may be detachably coupled to the strap via the same connection point(s) as one of the member(s). For instance, in order from the inward-facing side of the strap, the fastener(s) may pass through the strap and then through either one of the members (e.g., the first member) or the retainer loop, in no particular order. In some examples, the retainer loop may surround the circumference of the strap. When the belt is being worn by a user or a buckle connection is otherwise made, the end of the strap that is to be overlapped/occluded may pass through the retainer loop (e.g., between the inward-facing surface of the strap and an interior surface of the retainer loop.

The subject-matter of the present disclosure will now be described more fully with reference to the accompanying drawings. However, it should be understood that the drawings are merely illustrative embodiments of the present disclosure, and the technologies disclosed herein may be embodied in many different forms and should not be construed as limited to the examples set forth herein. Additionally, the examples illustratively disclosed herein may be practiced in the absence of certain elements, regardless of whether or not those elements are specifically disclosed herein. That is, other arrangements and elements may be used in addition to or instead of those shown, and some elements may be omitted altogether.

FIG. 1 is a perspective view of an exemplary belt 100 including a multi-component buckle 102, in accordance with some embodiments of the present disclosure. As shown in FIG. 1, the belt 100 may include a strap 104 that is configured to wrap around the waist or hips of a user. In some examples, the strap 104 may comprise one or more pieces and/or layers of material (e.g., leather, plastic, etc.) that forms a main body of the belt 100. For instance, the strap 104 may comprise an outer layer and an inner, structural core. In some examples, the outer layer may be leather, vinyl, or another soft, pliable material, and the inner core may be plastic (e.g., polyethylene, polypropylene, PVC, Polycarbonate, etc.), metal (e.g., aluminum, or another type of ductile metal) or another type of rigid material. Additionally, or alternatively, the strap 104 may be a uniform portion of material (e.g., solid leather, etc.).

In some instances, the strap 104 may be associated with various dimensions in length, width, thickness, etc. For example, a length of the strap 104 may be in a range between 24 inches to 52 inches, a width of the strap 104 may be in a range of 1 inch to 3 inches, and a thickness of the strap 104 may be a range between ⅛ inch to ½ inch. However, these are merely exemplary dimensions, and other dimensions may be used. In examples, the strap 104 may include a first end and a second end. Additionally, the strap 104 may include an inward-facing side 106 and an outward-facing side 108.

In some examples, the belt 100 may include one or more members, such as the first member 110 and the second member 112 for detachably coupling a buckle 102 and/or a buckle component(s), such as the first component 118 and the second component 120 of the buckle 102. For instance, the member(s) 110, 112 may be configured to detachably couple to the strap 104 of the belt 100 via one or more connection point(s) 114 disposed in the strap 104. That is, in some examples, to couple the buckle 102 to the strap 104 of the belt 100, the member(s) 110, 112 may be detached from the strap 104, coupled with the respective buckle component(s), and then recoupled to the strap 104 along with the buckle 102 and/or the buckle component(s). For instance, the first member 110 may include a loop or section of material that is inserted through a female portion of the first component 118 of the buckle 102 to couple the first component 118 to the first member 110. Similarly, the second member 112 may include a similar loop or section of material that is inserted through a female portion of the second component 120 of the buckle 102 to couple the second component 120 to the second member 112. In examples, the configuration of the member(s) may allow a user to utilize a specific buckle of their choosing, such as the multi-component buckle 102 illustrated in FIG. 1, which is a quick-release buckle having a male portion (e.g., second component 120) and a female portion (e.g., first component 118) that couple together for a quick and secure connection.

In some examples, the connection point(s) 114 disposed in the strap 104 may include a set of holes through the strap 104 (e.g., drilled, punched, etc.) from the inward-facing side 106 to the outward-facing side 108. While the belt 100 illustrated in FIG. 1 includes connection point(s) 114 that are located at specific portions of the strap 104, in some instances, the connection point(s) 114 may span a full length of the strap 104 (e.g., from one end to another end). In some examples, the ends of the strap 104 may include one or more sets of the connection point(s) 114 for adjustability. For instance, the side of the belt 100 corresponding with the second member 112 includes multiple sets of the connection point(s) 114 for adjusting a size of the belt 100. For examples, the second member 112 may be detached from the strap 104 by loosening the fastener(s) 116, and then the second member 112 may be reattached to the strap 104 at a different set of the connection point(s) 114 to adjust the size of the belt 100. Although the connection point(s) 114 illustrated in the drawings show two connection point(s) for each respective location that the members may be coupled to the belt 100, it is to be understood that more or less connection points may be disposed at a respective location. For instance, a single connection point may be used, in some examples, so that only a single fastener may be required to secure a member to the belt. Additionally, or alternatively, three connection points (and three fasteners) may be used, four connection points (and four fasteners) may be used, etc.

As described herein, the connection point(s) 114 may, in some examples, be configured or sized in such a way that fastener(s) 116 may be inserted through the strap 104 via the connection point(s) 114 to detachably couple the member(s), as described herein. In some examples, the fastener(s) 116 may include Chicago screws, binding posts, screw posts, interlocking fasteners, rivets, nuts and bolts, and/or the like. For example, the first member 110 may be detachably coupled to the strap 104 by the fastener(s) 116 via first connection point(s) (not visible in FIG. 1) proximate the first end of the strap 104. Additionally, the second member 112 may be detachably coupled to the strap 104 by the fastener(s) 116 via the connection point(s) 114 proximate the second end of the strap 104. In some examples, the first member 110 and the second member 112 may include their own connection point(s) to detachably couple to the strap 104 using the fastener(s) 116. For instance, the first member 110 may include connection point(s) that align with the first connection point(s) proximate the first end of the strap 104, and the fastener(s) 116 may be inserted through the connection point(s) of both the first member 110 and the strap 104 to couple the first member 110 to the strap 104. Similarly, the second member 112 may include connection point(s) that align with the connection point(s) 114 proximate the second end of the strap 104, and the fastener(s) 116 may be inserted through the connection point(s) of both the second member 112 and the strap 104 to couple the second member to the strap 104.

In some examples, the belt 100 may be configured such that the first member 110 and the second member 112 are disposed on a same side of the strap 104. For instance, the first member 110 and the second member 112 may be disposed on the outward-facing side 108 of the strap 104. In this way, and as described herein, when the belt 100 is worn by a user, the end(s) of the strap 104 may at least partially overlap 122. That is, when the belt 100 is worn upon the user such that a connection is made between the first component 118 and the second component 120 of the buckle 102, the ends of the strap 104 may at least partially overlap 122 depending on the current size configuration of the belt 100. For instance, the outward-facing side 108 of one end of the strap 104 (e.g., the end corresponding with the second member 112) may contact the inward-facing side 106 of the other end of the strap 104 (e.g., the end corresponding with the first member 110). As an example, the inward-facing side 106 of the second member-end of the strap 104 may be proximate the user of the belt 100, the outward-facing side 108 of the second member-end of the strap 104 may be at least partially overlapped and/or occluded by the first member-end of the strap 104, and the inward-facing side 106 of the first-member end of the strap 104 may be proximate the outward-facing side 108 of the second-member end of the strap 104.

In some examples, the belt 100 may further include a retainer loop 124 detachably coupled to the strap 104 of the belt 100. In some examples, the retainer loop 124 may be detachably coupled to the strap 104 via the same connection point(s) as the first member 110. For instance, as shown in FIG. 1, in order from the inward-facing side 106 of the strap 104, the fastener(s) 116 may pass through the strap 104, then through the first member 110, and then through a portion of the retainer loop 124. However, the order may differ and the portion of the retainer loop 124 (e.g., that portion on the outward-facing side 108 of the belt 100) may be disposed between the first member 110 and the strap 104. In some examples, the retainer loop 124 may wrap around the entire circumference of the strap 104. When the belt 100 is being worn by a user or a connection is otherwise made between the first component 118 and the second component 120 of the buckle 102, the second-member 112 end of the strap 104 that is overlapped/occluded may pass through the retainer loop 124. That is, the end of the strap may pass through a space between the inward-facing side 106 of the strap 104 and an interior surface of the retainer loop 124.

Figure 2A:
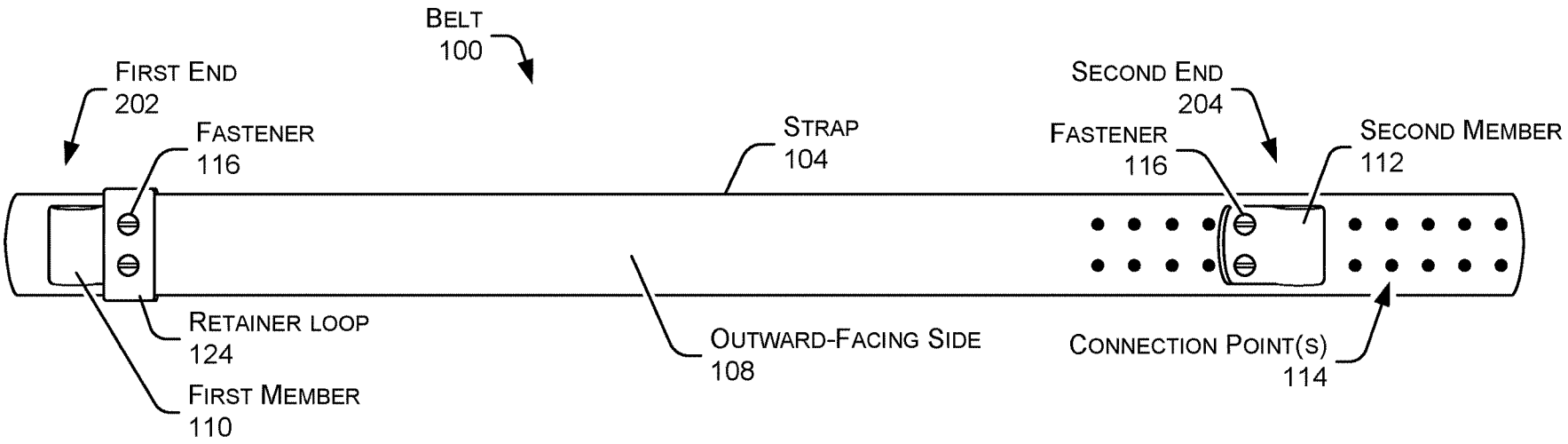
FIG. 2A is a head-on view of a first side of the exemplary belt, in accordance with some embodiments of the present disclosure.

FIG. 2A is a head-on view of a first side of the exemplary belt 100, in accordance with some embodiments of the present disclosure. The first side of the belt 100 shown in FIG. 2A may correspond with the outward-facing side 108 of the belt 100. As discussed above and herein, the belt 100 and/or the strap 104 may include a first end 202 and a second end 204 opposite the first end 202. In examples, the first member 110 and/or the retainer loop 124 may be detachably coupled to the first end 202 of the strap 104 of the belt 100 using the fastener(s) 116. The second end 204 of the strap 104 of the belt 100 may include the connection point(s) 114 disposed in the strap 104. The second member 112 may be detachably coupled to the second end 204 of the strap 104 by the fastener(s) 116 via the connection point(s) 114.

Figure 2B:
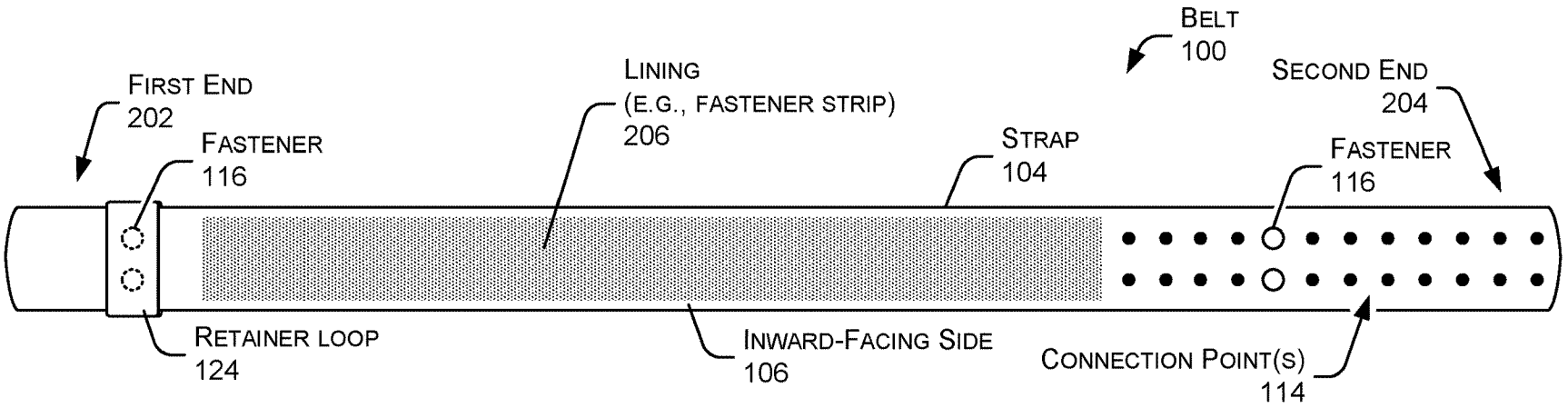
FIG. 2B is a head-on view of a second side of the exemplary belt, in accordance with some embodiments of the present disclosure.

FIG. 2B is a head-on view of a second side of the exemplary belt 100, in accordance with some embodiments of the present disclosure. The second side of the belt 100 shown in FIG. 2B may correspond with the inward-facing side 106 of the belt 100. In examples, the inward-facing side 106 of the belt 100 may include a lining 206 coupled to the strap 104. In some examples, the lining 206 may comprise a fastener strip, such as a hook and loop (e.g., Velcro) fastener. In examples, the first member 110 and/or the retainer loop 124 may be detachably coupled to the first end 202 of the strap 104 of the belt 100 using the fastener(s) 116. The fastener(s) 116 at the first end 202 of the belt 100 are represented using broken lines to indicate that the fastener(s) 116 are disposed under the retainer loop 124. That is, to create the space between the inward-facing side of the strap 104 and the inside surface of the retainer loop 124 for securing the second end 204 of the belt 100 when being worn by a user, the fastener(s) 116 may be disposed between the inward-facing side of the retainer loop 124 and the strap 104. In contrast, the fastener(s) 116 at the second end 204 of the belt 100 may be exposed and/or visible from the head-on view of the inward-facing side 106 of the belt 100.

Figure 3A:
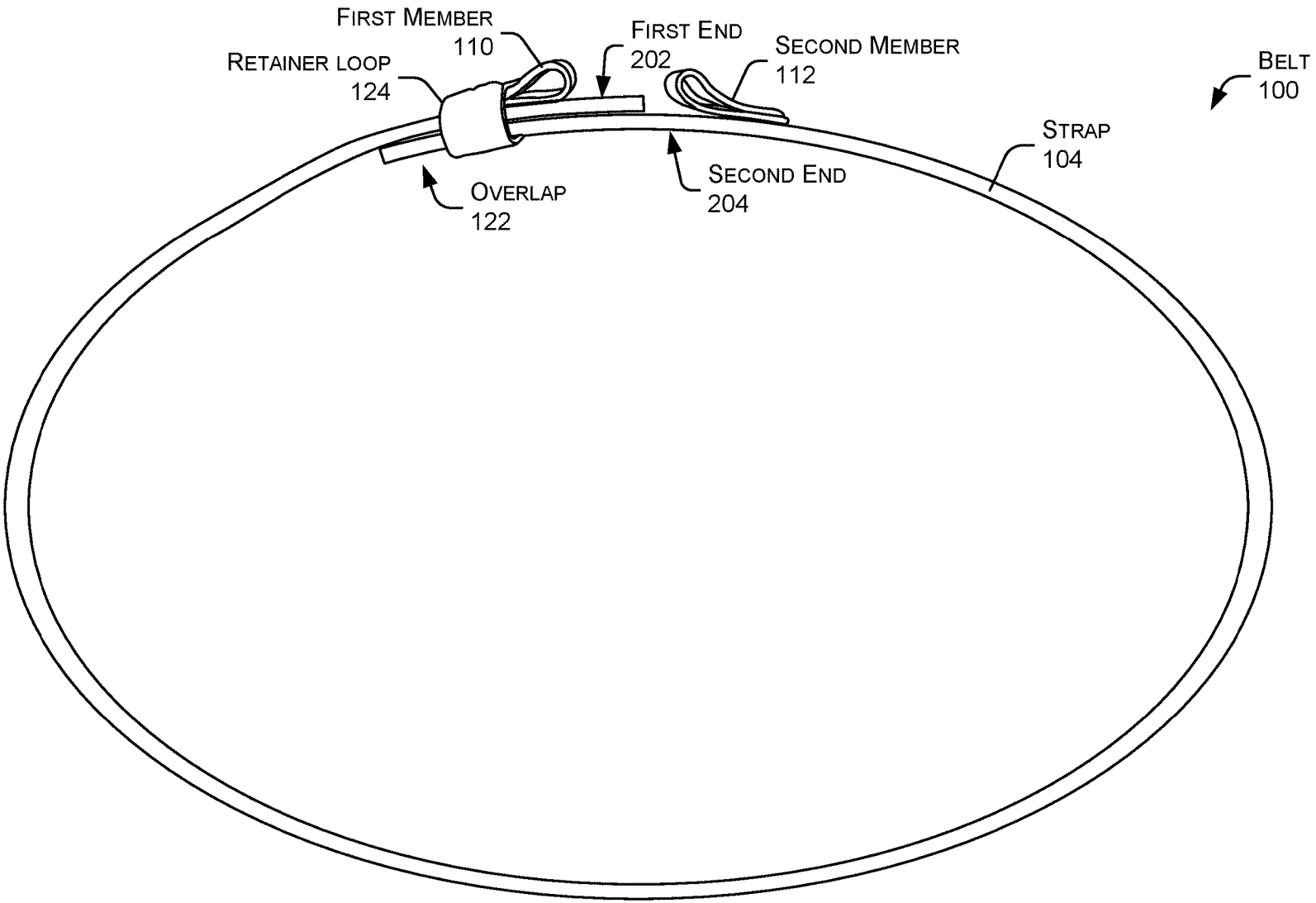
FIG. 3A is a top-down view of the exemplary belt illustrating example detail associated with a first end of the belt at least partially overlapping a second end of the belt, in accordance with some embodiments of the present disclosure.

FIG. 3A is a top-down view of the exemplary belt 100 illustrating example detail associated with the first end 202 of the belt 100 at least partially overlapping the second end 204 of the belt 100, in accordance with some embodiments of the present disclosure. For instance, when the belt 100 is in the configuration shown in FIG. 3A, such as, for instance, when the belt 100 is being worn by a user, the first end 202 of the strap 104 may at least partially overlap 122 the second end 204 of the strap 104. Additionally, as shown, the second end 204 of the strap 104 may be inserted through the retainer loop 124. That is, the second end 204 of the strap 104 may pass through a space between the inward-facing side of the first end 202 of the strap 104 and the inside surface of the retainer loop 124.

Figure 3B:
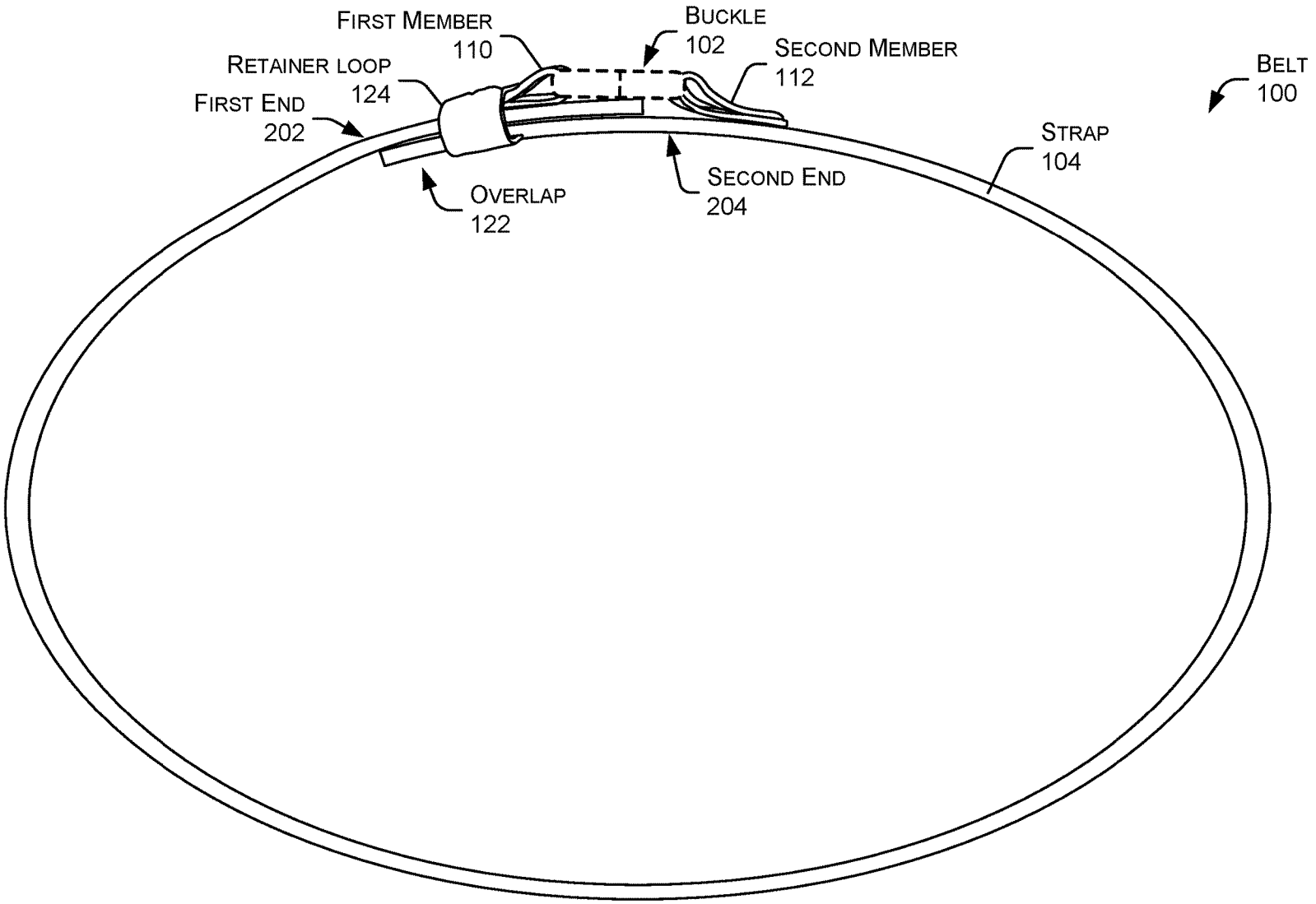
FIG. 3B is a top-down view of the exemplary belt including a multi-component buckle, in accordance with some embodiments of the present disclosure.

FIG. 3B is a top-down view of the exemplary belt 100 including a multi-component buckle 102, in accordance with some embodiments of the present disclosure. For instance, when the belt 100 is in the configuration shown in FIG. 3B, such as, for instance, when the belt 100 is being worn by a user and a connection is made with the buckle 102, the first end 202 of the strap 104 may at least partially overlap 122 the second end 204 of the strap 104. Additionally, as shown, the second end 204 of the strap 104 may be inserted through the retainer loop 124. That is, the second end 204 of the strap 104 may pass through a space between the inward-facing side of the first end 202 of the strap 104 and the inside surface of the retainer loop 124.

Figure 4A:
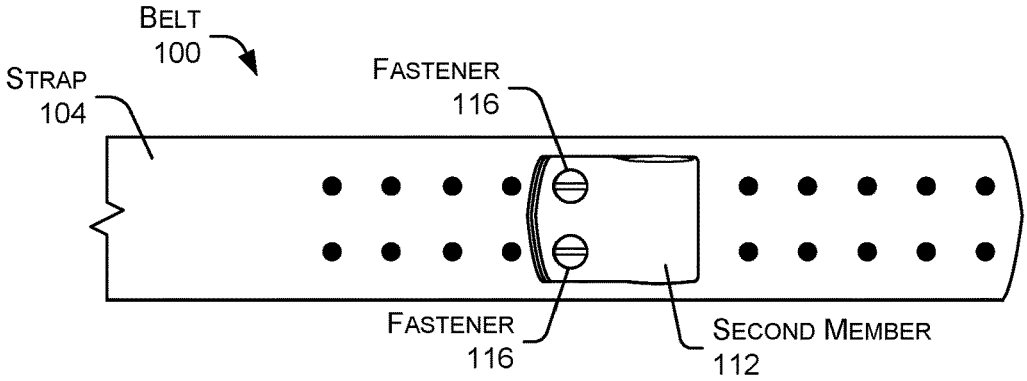
FIGS. 4A-4C collectively illustrate an example process for attaching a buckle component to the exemplary belt, in accordance with some embodiments of the present disclosure.
Figure 4B:
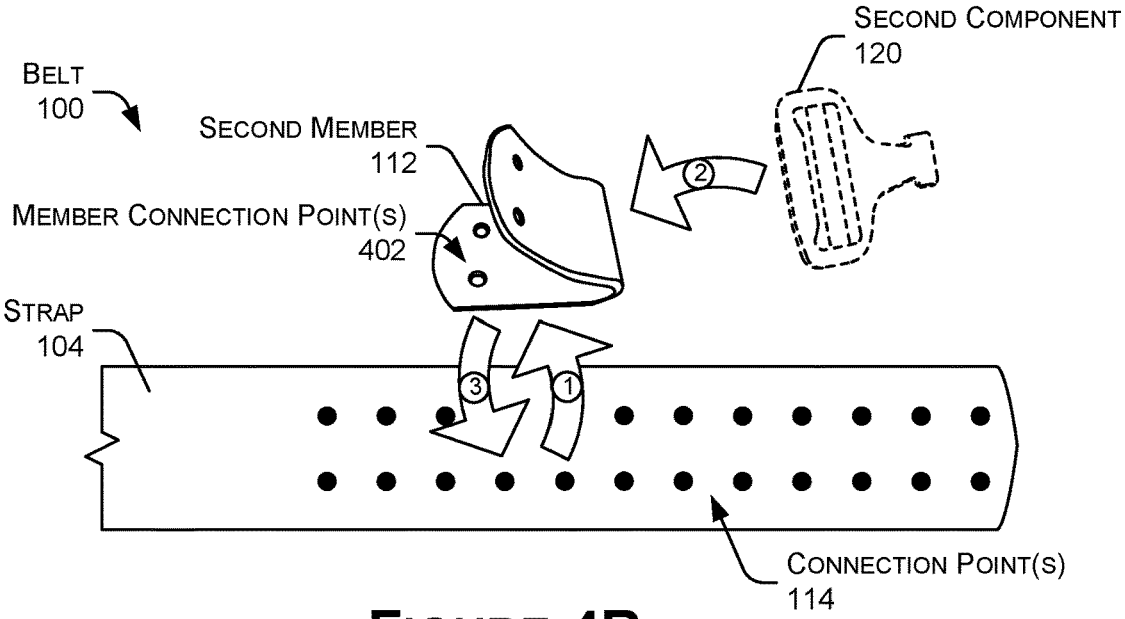
Figure 4C:
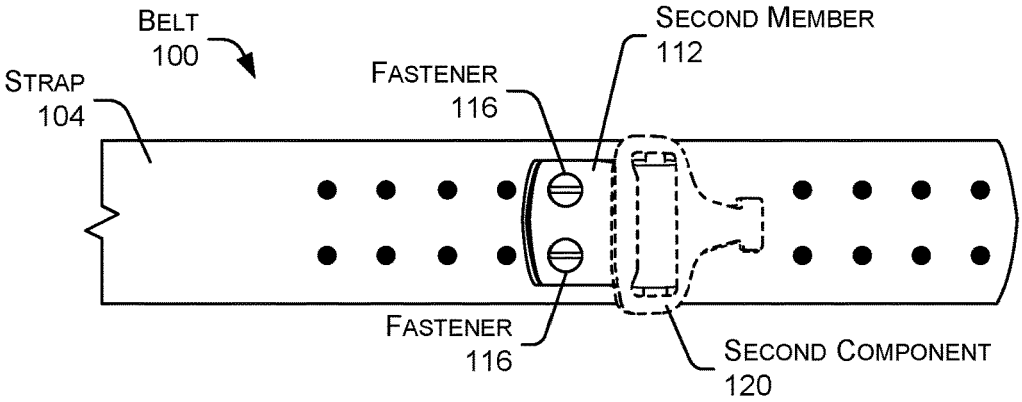

As shown by the differences between FIG. 3A and FIG. 3B, the buckle 102 may be detachably coupled to the belt 100 via the first member 110 and the second member 112. That is, the first member 110 and the second member 112 may each be detachably coupled from the strap 104 in order to couple the buckle 102. For instance, FIGS. 4A-4C collectively illustrate an example process for attaching a buckle component to the exemplary belt 100, in accordance with some embodiments of the present disclosure. In FIG. 4A, the belt 100 is shown in a configuration in which the second member 112 is coupled to the strap 104 using the fastener(s) 116. In FIG. 4B, at "1," the fastener(s) 116 are removed and the second member 112 is detached from the strap 104. At "2," the second component 120 may be coupled with the second member 112 by inserting a portion of the second member 112 through the second component 120. Then, at "3," the second member 112 and the second component 120 are re-coupled with the strap 104 by inserting the fastener(s) 116 through the connection point(s) of the strap 104 and the member connection point(s) 402 of the second member 112. FIG. 4C then illustrates the configuration of the belt 100 in which the second component 120 is coupled to the second member 112, which itself is coupled to the strap 104 by the fastener(s) 116. Although FIGS. 4A-4C illustrate an example of coupling the second component 120 to the second member 112 of the belt 100, similar techniques may be used for coupling the first component 118 to the first member 110 of the belt 100. For instance, the first member 110 may also include its own member connection point(s), and the retainer loop 124 may also include its own connection point(s) as well.

Figure 5A:
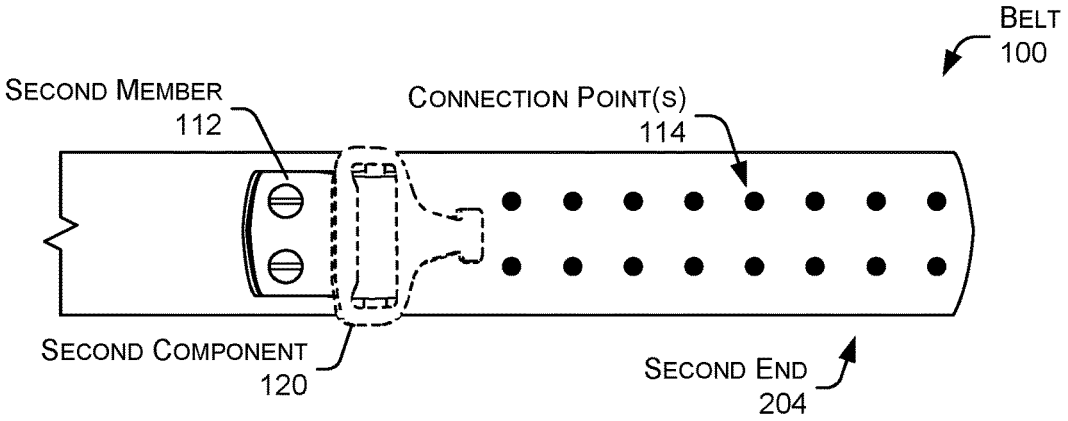
FIGS. 5A-5C illustrate example detail associated with adjusting a size of the exemplary belt, in accordance with some embodiments of the present disclosure.
Figure 5B:
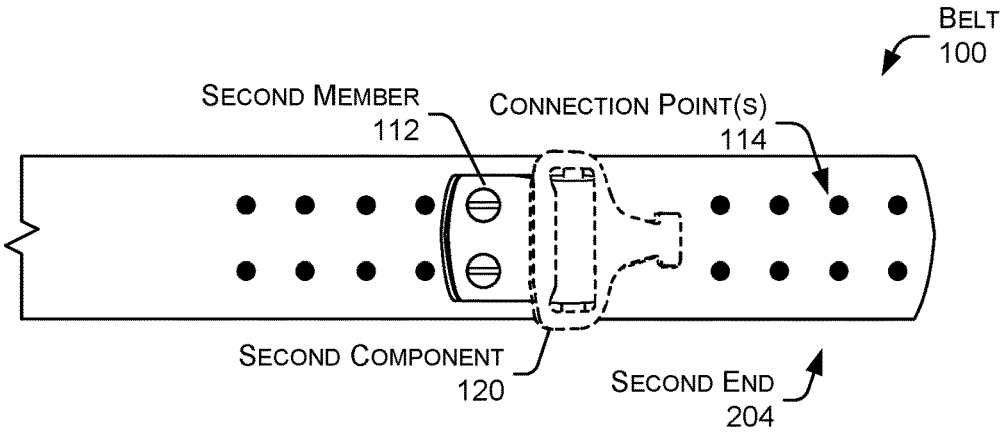
Figure 5C:
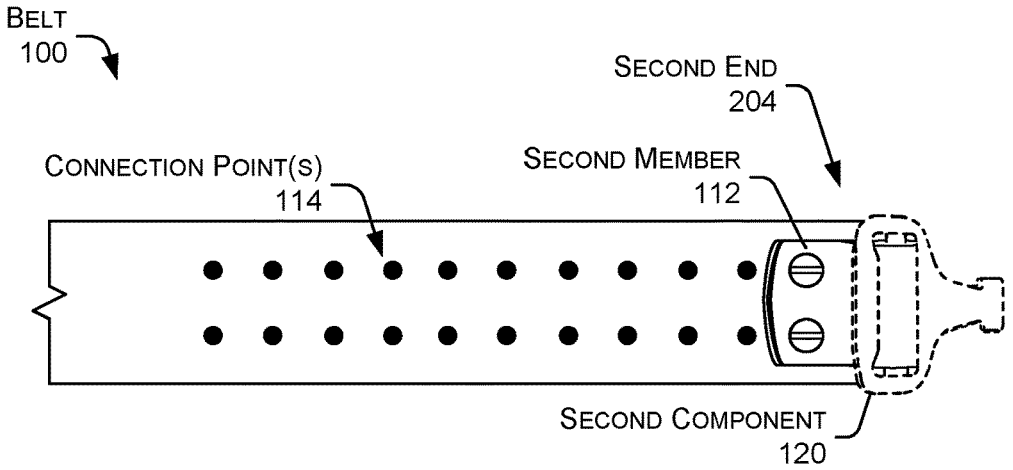

FIGS. 5A-5C illustrate example detail associated with adjusting a size of the exemplary belt 100, in accordance with some embodiments of the present disclosure. For instance, with respect to FIG. 5A, the belt 100 may be associated with a first size (e.g., 30 inches). The first size, in some instances, may be a smallest size the belt 100 is capable of. For instance, in FIG. 5A the second member 112 and the second component 120 are coupled to the belt 100 at a furthest connection point(s) 114 in from the second end 204 of the belt 100. As such, the belt 100 may be at its minimum size.

With reference to FIG. 5B, the belt 100 may be associated with a second size (e.g., 36 inches). The second size, in some instances, may be a mid-range size that the belt 100 is capable of being sized to. For instance, in FIG. 5B the second member 112 and the second component 120 are coupled to the belt 100 at a connection point(s) 114 that is roughly midway between the smallest setting and the largest setting of the belt 100.

With reference to FIG. 5C, the belt 100 may be associated with a third size (e.g., 42 inches). The third size, in some instances, may be a largest size the belt 100 is capable of being sized to. For instance, in FIG. 5C the second member 112 and the second component 120 are coupled to the belt 100 at a nearest connection point(s) 114 to the second end 204 of the belt 100. As such, the belt 100 may be at its maximum size. In such examples as shown in FIG. 5C where the belt 100 is at its maximum size, there may be no overlap of the second end 204 and the first end 202 of the belt 100. That is, because there is no excess portion of the strap of the belt 100 in front of the second member 112 and/or the second component 120, no overlap may exist.

Figure 6:
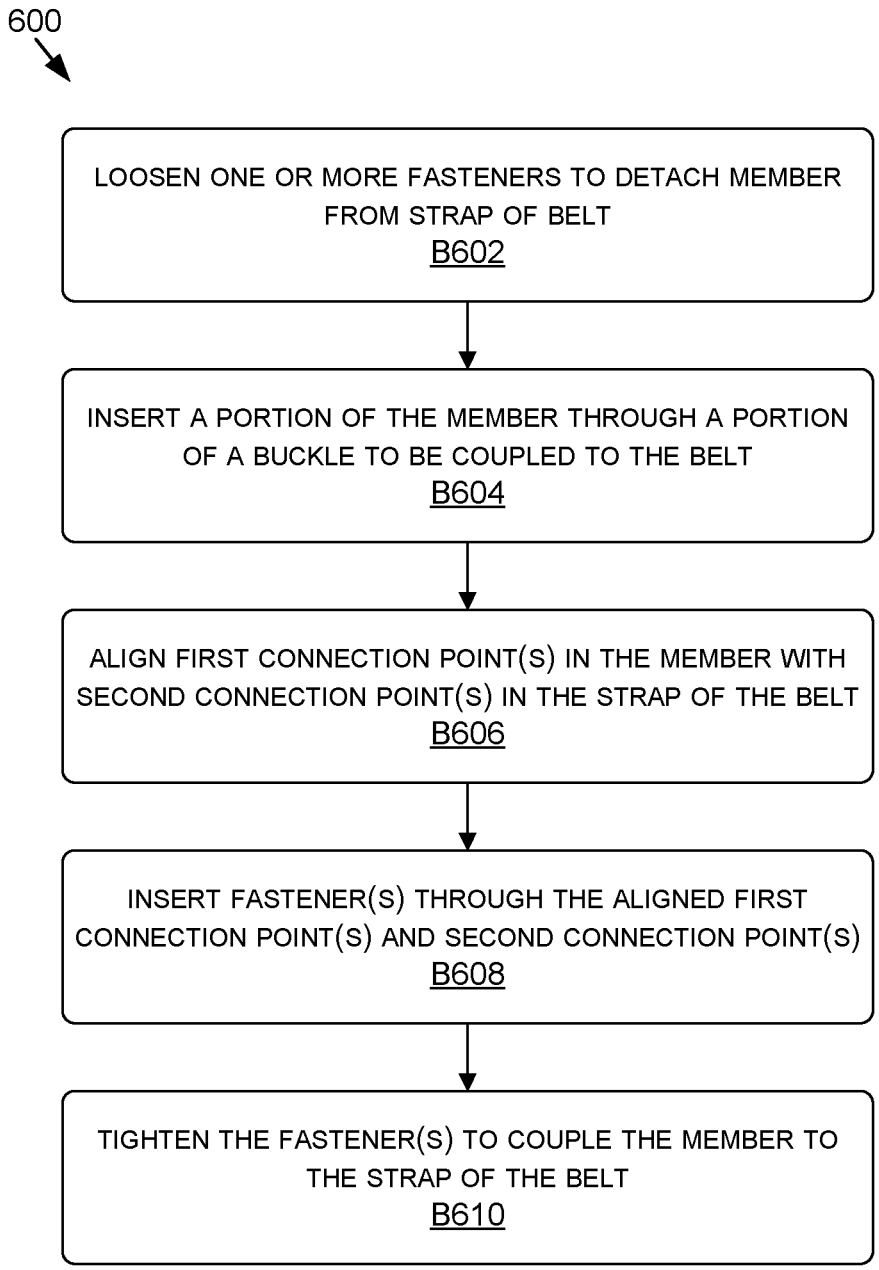
FIG. 6 is a flow diagram illustrating an example method associated with attaching a buckle component to a belt via an adjustable member of the belt, in accordance with some embodiments of the present disclosure.

FIG. 6 is a flow diagram illustrating an example method 600 associated with attaching a buckle to a belt via an adjustable member of the belt, in accordance with some embodiments of the present disclosure. At block B602, the method 600 may include loosening one or more fasteners to detach a member from a strap of a belt. For instance, the fastener(s) 116 may be loosened and/or removed to detach the first member 110 and/or the second member 112 from the strap 104 of the belt 100.

At block B604, the method 600 may include inserting a portion of the member through a portion of a buckle to be coupled to the belt. For instance, a portion of the first member 110 and/or the second member 112 may be inserted through a portion of the first component 118 and/or the second component 120. As an example, FIG. 4B illustrates the second member 112 being coupled with the second component 120 by inserting the second member 112 through the second component 120.

At block B606, the method 600 may include aligning first connection point(s) in the member with second connection point(s) in the strap of the belt. For instance, first connection point(s) of the first member 110 and/or the second member 112 may be aligned with second connection point(s) 114 in the strap 104 of the belt 100. Again, with reference to FIG. 4B, the member connection point(s) 402 may be aligned with the connection point(s) 114 in the strap 104 of the belt 100.

At block B608, the method 600 may include inserting fastener(s) through the aligned first connection point(s) and second connection point(s). For instance, the fastener(s) 116 may be inserted through the aligned first connection point(s) (of the first member 110 and/or the second member 112) and the second connection point(s) 114.

At block B610, the method 600 may include tightening the fastener(s) to couple the member to the strap of the belt. For instance, the fastener(s) 116 may be tightened to secure the first member 110 and/or the second member 112 to the strap 104 of the belt 100.

Figure 7:
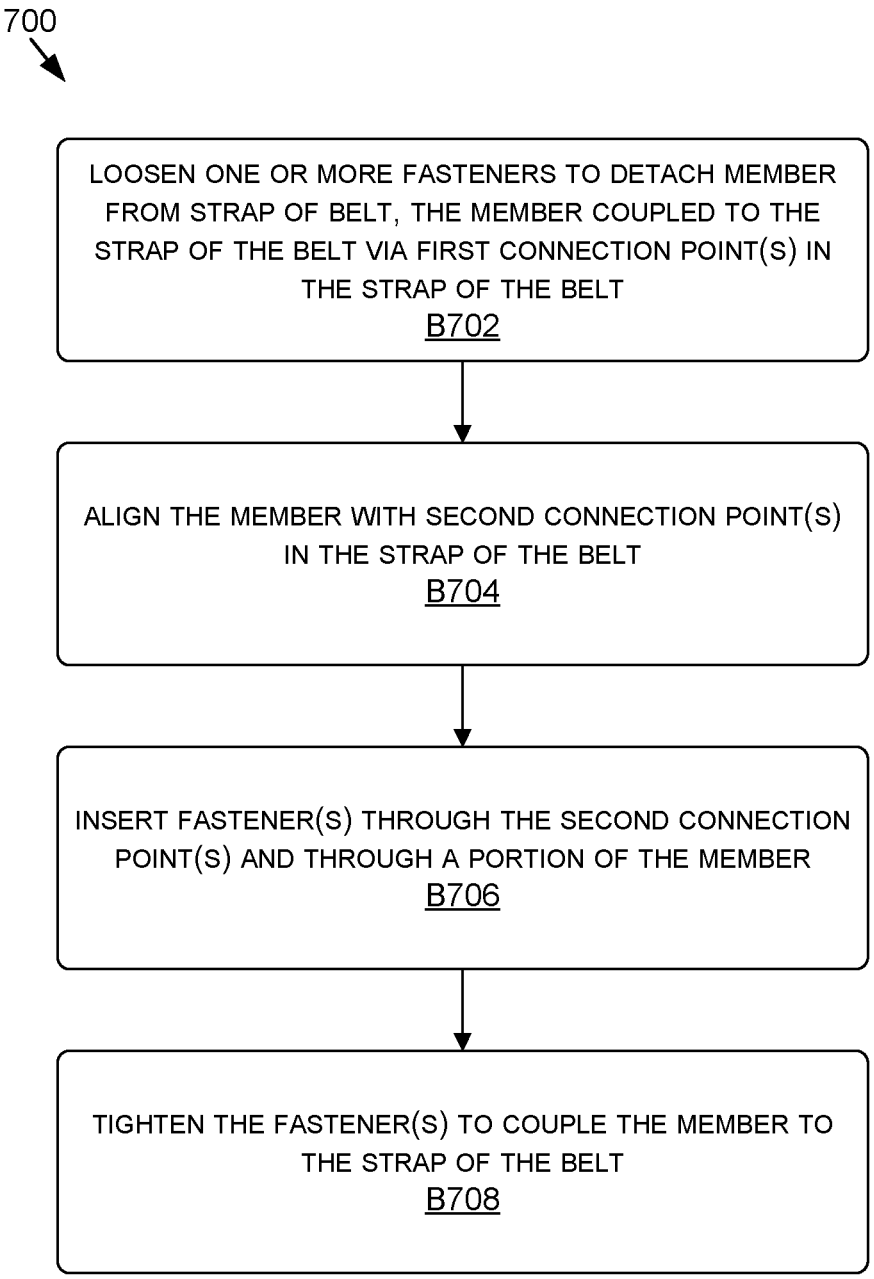
FIG. 7 is a flow diagram illustrating an example method associated with adjusting a size of a belt, in accordance with some embodiments of the present disclosure.

FIG. 7 is a flow diagram illustrating an example method 700 associated with adjusting a size of a belt, in accordance with some embodiments of the present disclosure. At block B702, the method 700 may include loosening one or more fasteners to detach member from strap of belt, the member coupled to the strap of the belt via first connection point(s) in the strap of the belt. For instance, the fastener(s) 116 may be loosened and/or removed to detach the second member 112 from the strap 104 of the belt 100. The second member 112 may be coupled to the strap 104 via a first set of the connection point(s) 114.

At block B704, the method 700 may include aligning the member with second connection point(s) in the strap of the belt. For instance, the member connection point(s) 402 may be aligned with the second connection point(s) 114 in the strap 104 of the belt 100. For instance, the first connection point(s) of block B702 may be associated with a first size of the belt, and the second connection point(s) of block B704 may be associated with a second size of the belt.

At block B706, the method 700 may include inserting fastener(s) through the second connection point(s) and through a portion of the member. For instance, the fastener(s) 116 may be inserted through the second connection point(s) and through a portion of the second member 112 (e.g., via the member connection point(s) 402).

At block B708, the method 700 may include tighten the fastener(s) to couple the member to the strap of the belt. For instance, the fastener(s) 116 may be tightened to secure the second member 112 to the strap 104 of the belt 100 at a location corresponding with the second connection point(s).

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

The subject matter of the present disclosure is described with specificity herein to meet statutory requirements. However, the description itself is not intended to limit the scope of this disclosure. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

EXAMPLE PARAGRAPHS

A. A belt comprising: a strap; a first buckle attachment member for detachably coupling a first buckle component to the strap proximate a first end of the strap; a second buckle attachment member for detachably coupling a second buckle component to the strap proximate a second end of the strap; and multiple connection points for adjusting a position of at least one of the first buckle attachment member or the second buckle attachment member to adjust a size of the belt, the multiple connection points disposed in the strap proximate at least one of the first end or the second end, wherein the first buckle attachment member and the second buckle attachment member are each disposed on an outward-facing side of the strap.

B. The belt of paragraph A, wherein the first end of the strap at least partially overlaps the second end of the strap when a connection is made between the first buckle component and the second buckle component.

C. The belt of any one of paragraphs A-B, wherein: an inward-facing side of the second end of the strap is proximate a user of the belt, the outward-facing side of the second end of the strap is at least partially overlapped and at least partially occluded by the first end of the strap, and the inward-facing side of the first end of the strap is proximate the outward-facing side of the second end of the strap.

D. The belt of any one of paragraphs A-C, wherein the at least one of the first buckle attachment member or the second buckle attachment member is configured to detachably couple to the strap of the belt via the multiple connection points.

E. The belt of any one of paragraphs A-D, wherein the second buckle attachment member is detachably coupled to the strap via a first connection point of the multiple connection points, and adjusting the position of the second buckle attachment member comprises: decoupling the second buckle attachment member from the strap at the first connection point; and detachably coupling the second buckle attachment member to the strap via a second connection point of the multiple connection points.

F. The belt of any one of paragraphs A-E, wherein the first buckle attachment member is detachably coupled to the strap of the belt proximate the first end via an connection point of the multiple connection points disposed in the strap proximate the first end.

G. The belt of any one of paragraphs A-F, further comprising a retainer loop detachably coupled to the strap of the belt proximate the first end.

H. The belt of any one of paragraphs A-G, wherein the second end of the strap is configured to pass through an opening between the retainer loop and an inward-facing side of the first end of the strap.

I. The belt of any one of paragraphs A-H, wherein the first buckle attachment member and the retainer loop are each detachably coupled to the strap via a same connection point disposed in the strap proximate the first end.

J. A duty belt comprising: a first member for detachably coupling, to a first end of the duty belt, a first component of a multi-component buckle; and a second member for detachably coupling, to a second end of the duty belt, a second component of the multi-component buckle; wherein the first member and the second member are each disposed on a first side of the duty belt such that the first end at least partially overlaps the second end based at least on a connection being made between the first component and the second component of the multi-component buckle.

K. The duty belt of paragraph J, the second end further comprising multiple connection points for adjusting a position of the second member.

L. The duty belt of any one of paragraphs J-K, wherein adjusting the position of the second member from a first position to a second position adjusts a waist size associated with the duty belt.

M. The duty belt of any one of paragraphs J-L, wherein the first position is associated with a first connection point and the second position is associated with a second connection point.

N. The duty belt of any one of paragraphs J-M, wherein based at least on the connection being made between the first component and the second component of the multi-component buckle, the first side of the second end of the duty belt is proximate a second side of the first end of the duty belt.

O. The duty belt of any one of paragraphs J-N, the first end further comprising a loop, wherein based at least on the connection being made between the first component and the second component of the multi-component buckle, the second end is configured to pass through an opening between the loop and a second side of the duty belt.

P. The duty belt of any one of paragraphs J-O, wherein the first side is an outward-facing side of the duty belt and the second side is a user-facing side of the duty belt.

Q. The duty belt of any one of paragraphs J-P, the first end further comprising a loop for retaining an excess portion of the second end of the duty belt, wherein the first member and the loop are detachably coupled to the first end of the duty belt at a same connection point.

R. A belt comprising multiple connection points for adjusting a position of a member relative to a strap of the belt to adjust a size of the belt, the multiple connection points disposed in the strap proximate an end of the strap, the member configured to detachably couple to the strap of the belt to detachably couple a component of a buckle.

S. The belt of paragraph R, wherein the member is detachably coupled to the strap of the belt via a first connection point of the multiple connection points disposed on the strap proximate the end, and the adjusting the size of the belt comprises moving the member from the first connection point to a second connection point.

T. The belt of any one of paragraphs R-S, wherein the member is disposed on a same side of the strap of the belt as a second member such that, when worn by a user, at least a portion of the end of the belt is at least partially occluded by a second end of the belt.

What is claimed is:

1. A belt comprising:

a strap comprising a first side, a second side opposite the first side, and multiple connection points extending through the strap from the first side to the second side;

a first buckle attachment loop detachably coupled to the first side of the strap proximate a first end of the strap using one or more first screws inserted through one or more first connection points of the multiple connection points, the first buckle attachment loop configured to be inserted through at least a portion of a first buckle component to detachably couple the first buckle component to the strap;

a second buckle attachment loop detachably coupled to the first side of the strap proximate a second end of the strap using one or more second screws inserted through one or more second connection points of the multiple connection points, the second buckle attachment loop configured to be inserted through at least a portion of a second buckle component to detachably couple the second buckle component to the strap; and a retainer loop detachably coupled to the strap proximate the first end using the one or more first screws inserted through the one or more first connection points, wherein an excess portion of the strap between the second buckle attachment loop and the second end of the strap is configured to be inserted through a space between the retainer loop and the second side of the strap.

2. The belt of claim 1, further comprising the first buckle component and the second buckle component, wherein the first end of the strap is configured to at least partially overlap the excess portion of the strap when a connection is made between the first buckle component and the second buckle component.

3. The belt of claim 1, wherein:

the first side of the strap is configured to be an outward-facing side of the belt with respect to a user of the belt, and the second side of the strap is configured to be an inward-facing side of the belt with respect to the user.

4. The belt of claim 3, wherein, the excess portion of the strap is configured to be at least partially overlapped and at least partially occluded by the first end of the strap when worn by the user such that (i) the first side of the excess portion of the strap is in contact with the second side of the first end of the strap, and (ii) the second side of the excess portion of the strap is configured to be positioned next to the user of the belt.

5. The belt of claim 1, wherein the retainer loop is positioned around the first end of the strap and extends over the first buckle attachment loop such that the first buckle attachment loop is interposed between the retainer loop and the first side of the strap, and wherein the retainer loop is spaced apart from the second side of the strap to define the space between the retainer loop and the second side of the strap.

6. The belt of claim 1, wherein at least one of the one or more first screws or the one or more second screws comprise one or more binding posts or Chicago screws.

7. A duty belt comprising:

a strap comprising a first side, a second side opposite the first side, a first end, and a second end opposite the first end;

a first member configured to detachably couple, to the first end of the strap, a first component of a multi-component buckle, the first member comprising a first strip of material folded at an intermediate portion to define a first loop and one or more first flange portions, the first member detachably coupled to the first side of the strap proximate the first end using one or more first screws inserted through one or more first connection points aligned across the one or more first flange portions and the strap, the first loop configured to receive at least a portion of the first component of the multi-component buckle; and a second member configured to detachably couple, to the second end of the strap, a second component of the multi-component buckle, the second member comprising a second strip of material folded at an intermediate portion to define a second loop and one or more second flange portions, the second member detachably coupled to the first side of the strap proximate the second end using one or more second screws inserted through one or more second connection points aligned across the one or more second flange portions and the strap, the second loop configured to receive at least a portion of the second component of the multi-component buckle further comprising a retainer loop positioned around the first end of the strap and detachably coupled to the strap using the one or more first screws.

8. The duty belt of claim 7, wherein the second end of the strap comprises multiple connection points configured for adjusting a distance between the second member and the second end of the strap.

9. The duty belt of claim 8, wherein the adjusting of the distance between the second member and the second end of the strap is configured to adjust a waist size associated with the duty belt.

10. The duty belt of claim 7, further comprising the multi-component buckle, wherein based at least on a connection being made between the first component and the second component of the multi-component buckle, the first side of the second end of the duty belt is configured to be in contact with the second side of the first end of the duty belt.

11. The duty belt of claim 7, wherein the retainer loop extends over the one or more first flange portions of the first member such that the one or more first flange portions are interposed between the retainer loop and the first side of the strap.

12. The duty belt of claim 7, wherein a space is defined between the retainer loop and the second side of the strap, and an excess portion of the strap between the second member and the second end is configured to pass through the space.

13. The duty belt of claim 7, wherein at least one of the one or more first screws or the one or more second screws comprise one or more binding posts or Chicago screws.

14. A system comprising:

a multi-component buckle comprising a first component and a second component;

a strap comprising a first side, a second side opposite the first side, a first end, and a second end opposite the first end;

a first member comprising a first strip of material folded at an intermediate portion to define a first loop and one or more first flange portions, the first member configured to detachably couple to the first side of the strap proximate the first end using one or more first fasteners inserted through one or more first connection points aligned across the one or more first flange portions and the strap, the first loop configured to support the first component of the multi-component buckle; and a second member comprising a second strip of material folded at an intermediate portion to define a second loop and one or more second flange portions, the second member configured to detachably couple to the first side of the strap proximate the second end using one or more second fasteners inserted through one or more second connection points aligned across the one or more second flange portions and the strap, the second loop configured to support the second component of the multi-component buckle further comprising a retainer loop, the retainer loop configured to be detachably coupled to the first side of the strap proximate the first end using at least one of the one or more first fasteners.

15. The system of claim 14, wherein the retainer loop is configured to extend over the one or more first flange portions of the first member and define a space between the retainer loop and the second side of the strap, the space configured to receive an excess portion of the second end of the strap.

16. The system of claim 14, wherein the first component and the second component of the multi-component buckle are configured to couple together to secure the first end of the strap to overlap with the second end of the strap.

17. The system of claim 14, wherein at least one of the one or more first fasteners or the one or more second fasteners comprise one or more binding posts or Chicago screws.

* * * * *